US008739865B1

(12) United States Patent
Smith et al.

(10) Patent No.: US 8,739,865 B1
(45) **Date of Patent: *Jun. 3, 2014**

(54) FLANGED END RING FOR USE WITH SWELL PACKERS

(71) Applicant: LB Enterprises, LLC, Anchorage, AK (US)

(72) Inventors: Lee Morgan Smith, Anchorage, AK (US); Betty A. Eastup-Smith, Anchorage, AK (US)

(73) Assignee: LB Enterprises, LLC, Anchorage, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/963,065

(22) Filed: Aug. 9, 2013

Related U.S. Application Data

(60) Provisional application No. 61/699,999, filed on Sep. 12, 2012.

(51) Int. Cl.

| | |
|---|---|
| ***E21B 17/02*** | (2006.01) |
| ***E21B 23/06*** | (2006.01) |
| ***E21B 33/12*** | (2006.01) |

(52) U.S. Cl.
USPC ..... 166/242.6; 166/242.1; 166/187; 166/387

(58) Field of Classification Search
USPC ..... 166/122, 187, 242.1, 242, 6, 387
See application file for complete search history.

(56) References Cited

U.S. PATENT DOCUMENTS

| | | | | |
|---|---|---|---|---|
| 7,762,322 | B2 * | 7/2010 | Andersen et al. | 166/118 |
| 7,784,550 | B2 * | 8/2010 | Nutley et al. | 166/378 |
| 2009/0229816 | A1 * | 9/2009 | Lemme et al. | 166/179 |
| 2010/0263880 | A1 * | 10/2010 | Carter | 166/387 |
| 2010/0300689 | A1 * | 12/2010 | McRobb et al. | 166/285 |
| 2012/0145412 | A1 * | 6/2012 | Andersen et al. | 166/387 |
| 2012/0255786 | A1 | 10/2012 | Isenhour | |

* cited by examiner

*Primary Examiner* — David Bagnell
*Assistant Examiner* — Richard Alker
(74) *Attorney, Agent, or Firm* — Buskop Law Group, PC; Wendy Buskop

(57) ABSTRACT

An end ring for a swell packer for use in a wellbore, wherein the swell packer has a central metal tubular with a rubber exterior tubular disposed over the central metal tubular. The rubber exterior tubular can swell in the presence of a well completion fluid and the end ring can sealingly engage one end of the rubber exterior tubulars disposed over the central metal tubular.

7 Claims, 2 Drawing Sheets

FLANGED END RING FOR USE WITH SWELL PACKERS

CROSS REFERENCE TO RELATED APPLICATION

The present application claims priority to and the benefit of U.S. Provisional Patent Application Ser. No. 61/699,999 filed on Sep. 12, 2012, entitled: "FLANGED END RING FOR USE WITH SWELL PACKERS." This reference is hereby incorporated in its entirety.

FIELD

The present embodiments generally relate to a flanged end ring for use with swell packers.

BACKGROUND

A need exists for an easy to install end ring for swell packers that allows the swell packers to be easily positioned in a well bore.

A further need exists for an end ring that grips the rubber of a swell packer, preventing disengagement of the end ring and ensuring a second engagement with the swell packer by the end ring.

The present embodiments meet these needs.

BRIEF DESCRIPTION OF THE DRAWINGS

The detailed description will be better understood in conjunction with the accompanying drawings as follows.

Figure 1:
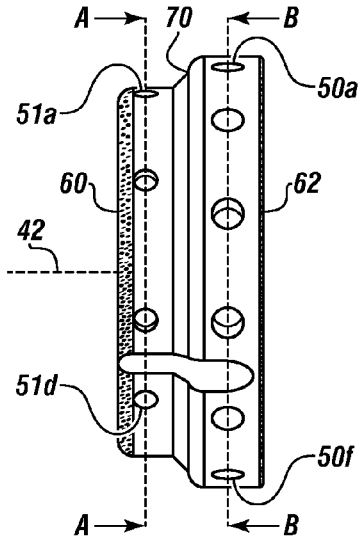
FIG. 1 is a detail of the screw holes formed in an end ring.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a flanged end ring for use with swell packers.

The flanged end ring can be used as a small reamer used in core drilling to ream while running into and out of a wellbore, namely reaming while drilling.

The present embodiments can further relate to a downhole tool that can be used to ream a wellbore with a wellbore axis, reaming in two directions, (i) into a wellbore and (ii) out of a wellbore.

The flanged end ring allows swell packers to go to the bottom of a wellbore very easily, 15 percent more easily than known swell packers without the flanged end ring.

The flanged end ring protects the rubber of the swell packer as the swell packer goes to the bottom, allowing the end rings to take the additional force generated when the swell packer is inserted into the well.

In one or more embodiments the end ring can be slightly larger, such as 10 percent larger in diameter than the outer diameter of the rubber element of the swell packer, which can allow the swell packer to run smoothly into and out of the wellbore, wherein the weight can be distributed onto the end ring. In this embodiment, the swell packer can ride or move on the end ring, which can in turn protect the rubber.

In an embodiment where the diameter of the rubber element is 5.675 inches, the end rings can be 5.70 inches in diameter, which can be 0.25 inches larger than the rubber element of the swell packer.

In another embodiment, the diameter of the rubber element can be from 0.010 inches to 0.5 inches, and the end ring can have a diameter of 5 percent to 10 percent larger than the rubber element of the swell packer.

In one or more embodiments, the end ring can use a double row of screws, one row of screws can be set in the first portion of the ring with the larger diameter and one set of screws can be set in the second portion of the ring having the smaller diameter. The double row of screws holds the end ring preventing the rubber of the swell packer from expanding laterally and controlling rubber swelling to a direction perpendicular to the axis of the wellbore or drill pipe, thereby providing a higher pressure seal.

The end rings have flutes around the edges of the end ring allows lower hydraulic pressure in the well as the swell packers are run into the wellbore while not breaking the formation down as the swell packers are installed and not hanging up the packers in the wellbore.

The tool can be made from steel, stainless steel or high strength composite materials.

In one or more embodiments, the end ring can be beveled on all edges, which can prevent the device from hanging up or getting caught while running into and out of a wellbore.

In an embodiment, the screw holes in the end ring can be used to ream the wellbore. The carbide cutting material can be used to ream the ledges around the wellbore allowing the swell packers to be installed to a maximum wellbore depth. In one or more embodiments, the end rings can be used with 20 swell packers to 80 swell packers in line in a single run.

Turning now to the Figures, FIG. 1 is a detail of the screw holes formed in an end ring. The end ring will be described in more detail in later Figures.

A first metal ring portion and a second metal ring portion, which are described in later Figures, can have a plurality of screw holes, 50*a*-50*f*. The screw holes in the first metal ring portion can be larger in diameter to accommodate larger screws than the screw holes 51*a*-51*d* of the second metal ring portion.

The first and second ring portions can have carbide material 60 and 62. In one or more embodiments the carbide material can be a layer and/or can be a button of polycrystalline material, such as a diamond material; a PDC material, such as PDC buttons; or PDC cutters from Guilin Star Diamond Superhard Materials Company of China which can aid in reaming the wellbore.

The end ring is a ring structure, which can be hollow to grab the swell packer and formed around an axis 42. In one or more embodiments, each flute can be formed on the end ring longitudinal to the axis 42.

The first and second metal ring portions are integral with each other, such as by shoulder 70. The shoulder can be straight or angled depending upon application.

Figure 2:
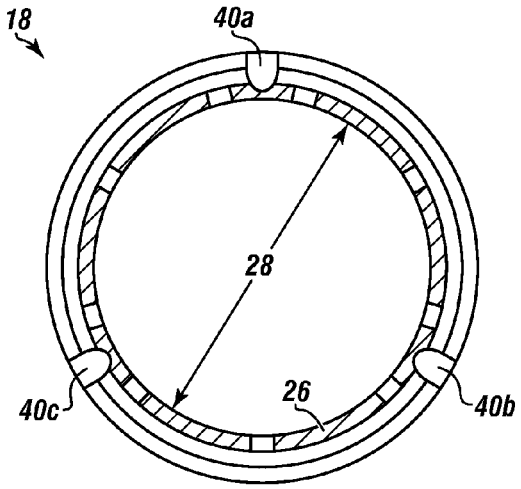
FIG. 2 is a cross sectional view, cut along line A-A, of the first and second metal ring portions of the end ring showing the flutes formed on the external edges between the first and second metal ring portions.

FIG. 2 shows the second metal ring portion 26 as having a second diameter 28 smaller than the first diameter.

The three flutes 40*a*, 40*b*, and 40*c* can be seen formed through the entire width of the second metal ring portion 26 and extending into a portion of the second metal ring portion. The plurality of flutes do no extend completely radially through the end ring.

In one or more embodiments, a third metal ring portion can be used. The third metal ring portion can have a third diameter that is smaller than the second diameter, and the first, second and third metal ring portions are all integrally connected.

Figure 3:
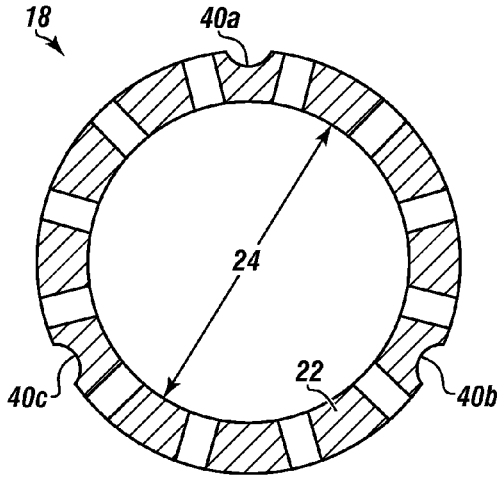
FIG. 3 is a cross sectional view, cut along line B-B, of a first metal ring portion of an end ring according to an embodiments.

FIG. 3 shows the end ring 18 for a swell packer.

The apparatus can be usable with swell packers, which can be made from a central metal tubular with a rubber exterior tubular disposed over the central metal tubular. The rubber exterior tubular swells either in the presence of a well completion fluid such as water, oil or other well drilling fluids.

The end ring 18 sealingly engages one end of the rubber exterior tubular disposed over the central metal tubular.

The first metal ring portion 22 of the end ring 18 with three flutes 40*a*, 40*b*, and 40*c* formed in the exterior side of the first metal ring portion 22. The first metal ring portion 22 can have a first diameter 24.

Figure 4:
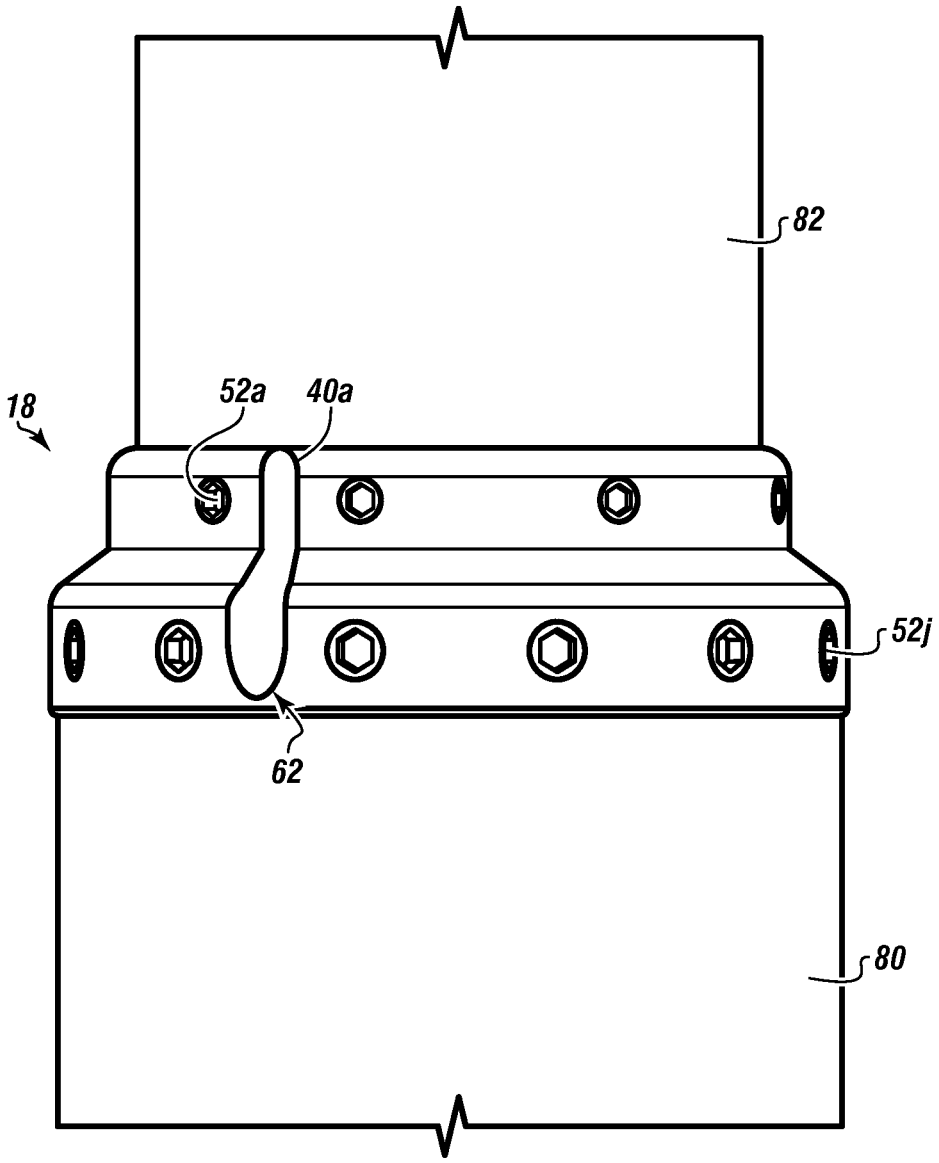
FIG. 4 is a side view of an end ring attached to two different sized swell packers using the end ring with a first and second metal ring portion.

FIG. 4 shows a plurality of screws 52*a*-52*j*. Each screw engages through the screw holes to connect the end ring 18 to the rubber exterior tubular disposed over the central metal tubular.

In an embodiment, the end ring can engage a diffuser layer around the rubber tubular of the swell packer.

FIG. 4 shows that flute 40*a* can have at least one tapered end 62*a*.

In an embodiment, a third metal ring portion with a third diameter can be disposed between the first metal ring portion and the second metal ring portion.

In one or more embodiments, from 2 screw holes to 20 screw holes can be used per metal ring portion. The amount of screw holes can differ in each metal ring portion.

In one or more embodiments, the first metal ring portion can have an outer diameter ranging from 1 inch to 36 inches.

In one or more embodiments, from 2 flutes to 20 flutes per metal ring portion can be used.

In still other embodiments, the flutes can each have a depth from 5 percent to 55 percent of the thickness of one of the metal ring portions.

The metals can be made from stainless steel.

In an embodiment, one of the metal ring portions can be made from a first material and a second of the metal ring portions can be made from a different material to provide for different physical properties, such as improved durometer and/or better gripping.

In an embodiment, the edges of the rings can have teeth, such as razor like jagged teeth, to better grip the rubber of the swell packer.

A swell packer 80 with a first outer diameter is shown connected to the end ring 18 and a second swell packer 82 with a second outer diameter is shown connected to the other side of the end ring 18.

In embodiments, the end ring 18 can connect two different swell packers together, one for oil and one for water.

While these embodiments have been described with emphasis on the embodiments, it should be understood that within the scope of the appended claims, the embodiments might be practiced other than as specifically described herein.

What is claimed is:

1. An end ring for a swell packer for use in a wellbore, wherein the swell packer has a central metal tubular with a rubber exterior tubular disposed over the central metal tubular, and wherein the rubber exterior tubular swells in the presence of a well completion fluid, and wherein the end ring sealingly engages one end of the rubber exterior tubular of the swell packer, and wherein the end ring comprises:

a. a first metal ring portion having a first outer diameter;

b. a second metal ring portion integral with the first metal ring portion, wherein the second metal ring portion has a second outer diameter, wherein the second outer diameter is larger than the first outer diameter;

c. a plurality of flutes formed between the first metal ring portion and the second metal ring portion and an integral shoulder solidly connecting the first metal ring portion to the second metal ring portion, wherein each flute is formed on the end ring longitudinal to a longitudinal axis of the wellbore, and wherein each flute extends from the first metal ring portion through the integral shoulder to the second metal ring portion on external sides of the integral shoulder and the first and second metal ring portions, wherein the plurality of flutes do not extend completely radially through the end ring;

d. a plurality of screw holes disposed through each metal ring portion; and e. a plurality of screws, wherein each screw is for engaging the screw holes to connect the first or second metal ring portions to the rubber exterior tubular of the swell packer and pressure sealing the swell packer and preventing the rubber exterior tubular of the swell packer from expanding laterally and controlling the rubber exterior tubular to only expand in a direction perpendicular to the longitudinal axis of the wellbore while providing a high pressure seal with the swell packer with the first and second metal ring portions.

2. The end ring of claim 1, wherein the plurality of flutes have at least one tapered end.

3. The end ring of claim 1, wherein the plurality of screw holes range from two to twenty in number per metal ring portion.

4. The end ring of claim 3, wherein the number of screw holes differs in at least one metal ring portion.

5. The end ring of claim 1, wherein the first outer diameter is from 1 inch to 36 inches.

6. The end ring of claim 1, wherein the plurality of flutes are from two to twenty in number per end ring.

7. The end ring of claim 1, wherein the plurality of flutes each have a depth from five percent to fifty-five percent of the thicknesses of one of the metal ring portions.

* * * * *